US006698414B1

(12) United States Patent
Menow et al.

(10) Patent No.: US 6,698,414 B1
(45) Date of Patent: Mar. 2, 2004

(54) PRESSURE GAUGE FOR PNEUMATIC TOY GUN

(75) Inventors: Steven M. Menow, Yardley, PA (US); Michael Waters, Newton, PA (US); John Freitas, Newton, PA (US)

(73) Assignee: Hasbro Inc, Pawtucket, RI (US)

( * ) Notice: Subject to any disclaimer, the term of this patent is extended or adjusted under 35 U.S.C. 154(b) by 0 days.

(21) Appl. No.: 10/231,600

(22) Filed: Aug. 30, 2002

(51) Int. Cl.[7] ..... F41B 11/26; F41B 11/32

(52) U.S. Cl. ..... 124/69; 124/70; 124/71; 124/73

(58) Field of Search ..... 124/56, 63, 69, 124/70, 71, 73, 74, 76; 73/713, 715, 730, 731, 744; 116/34 A, 34 B, 34 R

(56) References Cited

U.S. PATENT DOCUMENTS

| | | | | | |
|---|---|---|---|---|---|
| 2,618,977 | A | * | 11/1952 | Hottenroth | 73/715 |
| 2,701,966 | A | * | 2/1955 | Brown | 73/713 |
| 3,739,764 | A | * | 6/1973 | Allport | 124/70 |
| 3,780,693 | A | * | 12/1973 | Parr | 116/270 |
| 4,343,188 | A | * | 8/1982 | Baker | 73/706 |
| 4,784,107 | A | | 11/1988 | Kelly | |
| 5,337,726 | A | | 8/1994 | Wood | |
| RE35,412 | E | | 12/1996 | Johnson et al. | |
| D410,048 | S | | 5/1999 | Luk | |
| 6,142,135 | A | * | 11/2000 | Thompson | 124/70 |
| 6,279,562 | B1 | * | 8/2001 | Clayton | 124/59 |
| 6,439,216 | B1 | * | 8/2002 | Johnson et al. | 124/70 |
| 2003/0127085 | A1 | * | 7/2003 | Brunette et al. | 124/74 |

* cited by examiner

*Primary Examiner*—Charles T. Jordan
*Assistant Examiner*—John W. Zerr
(74) *Attorney, Agent, or Firm*—Marshall, Gerstein & Borun LLP

(57) ABSTRACT

The present invention is directed to a pneumatic toy gun which may include a cylinder having an open end and an outlet, a piston disposed within the open end of the cylinder, and a valve having a valve inlet and a discharge outlet. The valve may have a normal position wherein the discharge outlet is sealed to prevent the flow of air through the discharge outlet, and an open position wherein the discharge outlet is unsealed to permit the flow of air through the discharge outlet, with the outlet of the cylinder being in fluid communication with the valve inlet. The pneumatic toy gun may further include a pressure gauge in fluid communication with the outlet of the cylinder and the valve inlet, with the pressure gauge having a cavity with a fluid disposed therein, and the cavity having a transparent portion through which the fluid is visible. Movement of the piston within the cylinder compresses air in the cylinder and the valve to increase the air pressure therein, and the amount of the fluid visible through the transparent portion of the pressure gauge may be proportional to the air pressure in the cylinder and the valve.

27 Claims, 7 Drawing Sheets

PRESSURE GAUGE FOR PNEUMATIC TOY GUN

BACKGROUND

The patent is directed to a pneumatic toy projectile launcher, and more particularly to a liquid-filled pressure gauge for indicating the amount of air pressure built up in a pneumatic toy projectile launcher.

Various pneumatic toy projectile launchers have been previously described. For example, U.S. Pat. No. 4,784,107 to Kelly discloses a ball pitching system comprising a pneumatically actuated pitching arm and automatic ball feed system. The pneumatic actuation is provided by an automatic pressure sensor valve. Compressed air is provided by a DC compressor affixed to the frame of the pitching apparatus and may be powered by a conventional 12 volt vehicular battery system. In this manner the preselected pitching of baseballs and the like along a predefined trajectory can be provided at remote locations away from conventional automotive electrical supply. A pressure gauge is disposed on a hollow frame section for monitoring the operation of the ball pitching system.

U.S. Pat. No. 5,337,726 to Wood discloses a pneumatic driven ball thrower employing a pressurized gas to move a piston and connecting rod against a ball at rapid velocity to move the ball a pre-determined velocity. The pressurized gas ram at a pre-determined amount of pressurized gas in a very brief period of time to rapidly accelerate the piston and rod. The device employs a pressurized gas reservoir in proximity to the pressurized gas ram employing a valve with a large gas passage which opens rapidly permitting rapid passage of the pressurized gas from the gas reservoir to the pressurized gas ram. The housing assembly of the ball thrower has a hand grip, a three-way valve with an inlet port and an exhaust port, a trigger and a gas pressure gauge.

SUMMARY OF THE INVENTION

In one aspect, the invention is directed to a pressure gauge for a pneumatic toy gun that may include a bottom flange having an inlet, an outlet, an orifice, a resilient bladder, and an upper housing having a hollow interior wherein the inlet, the outlet and the orifice are in fluid communication with each other. The upper housing may be connected to the bottom flange with the bladder being disposed between the upper housing and the bottom flange, and with the orifice of the bottom flange being disposed proximate a surface of the bladder. The bladder may be affixed to the bottom flange to form an air-tight seal between the surface of the bladder and the bottom flange such that compressed air in the bottom flange imparts force on the surface of the bladder to deflect the bladder into the interior of the upper housing. The bladder may further be affixed to the upper housing to form an air-tight seal between the opposite surface of the bladder and the upper housing.

The pressure gauge may further include a transparent tube connected to an end of the upper housing opposite the bottom flange and bladder with the tube being in fluid communication with the hollow interior of the upper portion and being affixed to the upper portion to form an air-tight seal between the transparent tube and upper portion, and a cap connected to an end of the transparent tube opposite the upper portion with the cap being affixed to the transparent tube to form an air-tight seal between the transparent tube and upper portion. The pressure gauge may include a fluid retentively disposed within a cavity defined by the bladder, the upper portion, the transparent tube and the cap, with the volume of the fluid in the cavity being less than the volume of the cavity formed by the bladder, the upper portion, the transparent tube and the cap.

In another aspect, the present invention is directed to a pneumatic toy gun which may include a cylinder having an open end and an outlet, a piston disposed within the open end of the cylinder, and a valve having a valve inlet and a discharge outlet. The valve may have a normal position wherein the discharge outlet is sealed to prevent the flow of air through the discharge outlet, and an open position wherein the discharge outlet is unsealed to permit the flow of air through the discharge outlet, with the outlet of the cylinder being in fluid communication with the valve inlet The pneumatic toy gun may further include a pressure gauge in fluid communication with the outlet of the cylinder and the valve inlet, with the pressure gauge having a cavity with a fluid disposed therein, and the cavity having a transparent portion through which the fluid is visible. Movement of the piston within the cylinder compresses air in the cylinder and the valve to increase the air pressure therein, and the amount of the fluid visible through the transparent portion of the pressure gauge may be proportional to the air pressure in the cylinder and the valve.

In a further aspect, the present invention is directed to a pressure gauge for a pneumatic toy gun having a pressurizing mechanism for compressing air within the pneumatic toy gun. The pressure gauge may include an enclosed housing forming a cavity wherein the interior of the cavity may be isolated from the ambient environment. The enclosed housing may comprise a transparent portion and a movable portion, such as a resilient bladder or sliding piston, in fluid communication with the pressurizing mechanism of the pneumatic toy gun, with the movable portion being adapted to move into the cavity of the enclosed housing by an amount proportional to a force applied to the movable portion by the compressed air within the pneumatic toy gun. The pressure gauge may further include a fluid disposed within the cavity of the enclosed portion, wherein the amount of the fluid visible in the transparent portion may be proportional to the movement of the movable portion under the force of the compressed air.

Additional aspects of the invention are defined by the claims of this patent.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112 sixth paragraph.

Figure 1:
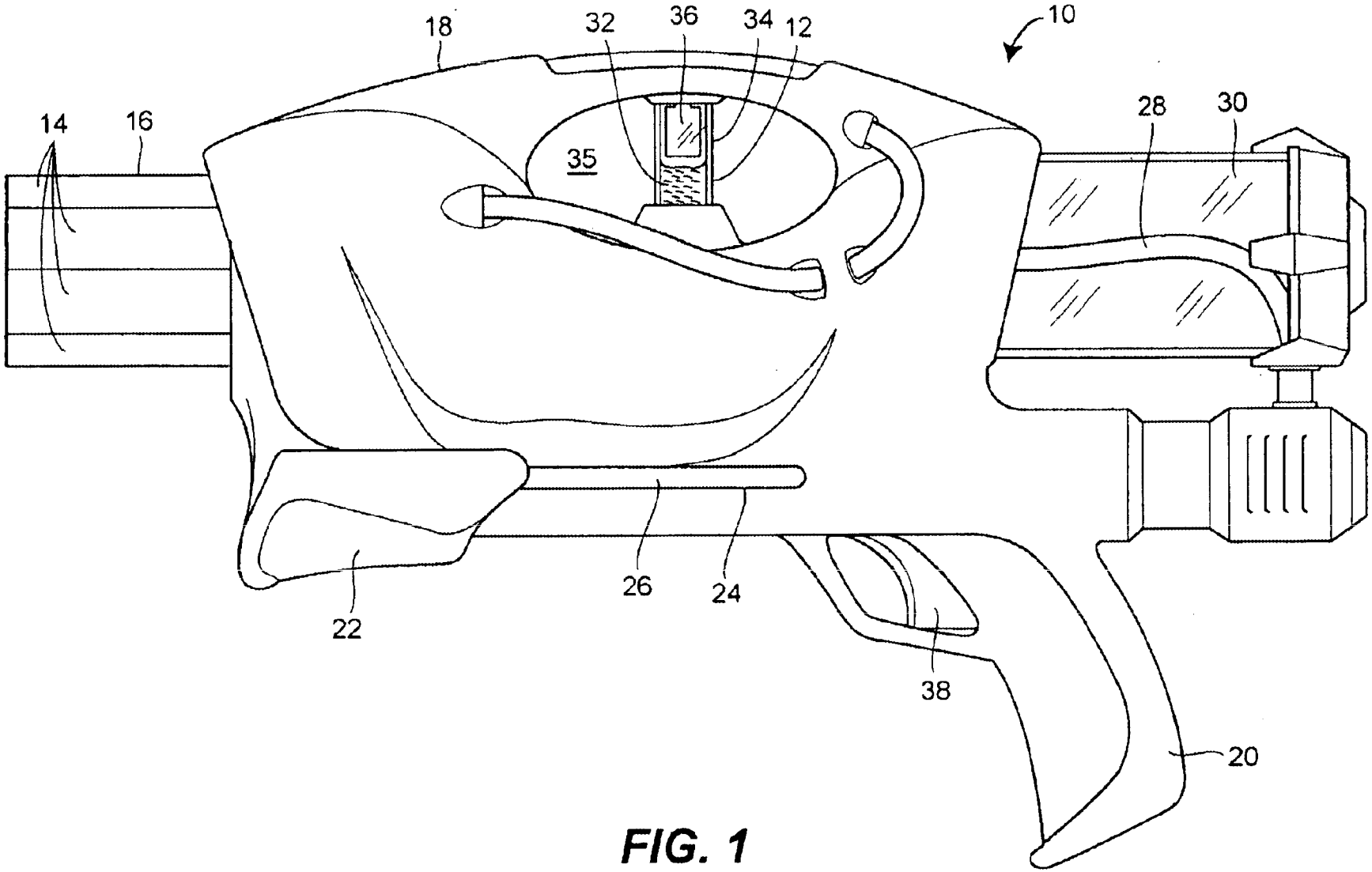
FIG. 1 is a side view of an embodiment of a pneumatic toy gun having a pressure gauge in accordance with the invention.

FIG. 1 illustrates one possible embodiment of a pneumatic toy gun 10 having a pressure gauge 12 in accordance with the invention. The embodiment of the pneumatic toy gun 10 illustrated in FIG. 1 may be configured in the form of a toy gun that may be adapted to launch a plurality of toy darts from a corresponding plurality of barrels 14 of a rotatable magazine 16. While the toy gun 10 as illustrated and described herein as having a plurality of barrels 14 for launching a plurality of toy darts, those skilled in the art will understand that pressure gauges 12 in accordance with the present invention may be implemented in pneumatic toy projectile launchers that launch other types of toy projectiles such as balls, disks, rings, rockets, and the like. The pressure gauges 12 may also be implemented in pneumatic launchers that discharge water, air, or other fluids, such as the water gun described in U.S. Pat. No. Re. 35,412, entitled "Double Tank Pinch Trigger Pump Water Gun," which is hereby expressly incorporated by reference herein. The pressure gauge 12 may also be implemented in pneumatic toy projectile launchers that retain and launch a single toy projectile, or that launch any number of toy projectiles that are held by a magazine or other mechanism until discharged by the projectile launcher. Implementation of pressure gauges in accordance with the present invention in other types of projectile launchers with other types of toy projectiles will be understood by those skilled in the art in view of the disclosure herein.

The toy gun 10 illustrated in FIG. 1 has an outer housing 18 that may include a hand grip 20 and a moving handle 22 that are grasped by the user of the toy gun 10. The handle 22 may slide within slots 24 in the housing 18 to drive a piston rod 26 and, consequently, an internal piston in a cylinder (not shown) to compress air within the toy gun 10 in preparation for launching a toy projectile. The housing 18 may further enclose a hose 28, which may be visible through a transparent portion 30 of the housing 18, which may be in fluid communication with the piston, the cylinder, and the pressure gauge 12 such that the pressure created by the piston and cylinder is measured by the pressure gauge 12. When the toy gun 10 is pressurized, the amount of pressure may be indicated by the level of a fluid 32 within the pressure gauge 12 that is visible in a transparent tube 34 through an opening 35 in the housing 18. As the pressure in the toy gun 10 increases, the level of the fluid 32 in the pressure gauge 12 may rise proportionately to provide the user with a visual indication of the amount of pressure in the toy gun 10. The visual indication provided by the pressure gauge 12 may appear more dramatic by having a body 36 disposed within the transparent tube 34 to reduce the volume of the cavity within the pressure gauge 12. With the reduced internal volume within the pressure gauge 12, the fluid 32 in the transparent tube 34 will rise to a higher level for a given amount of pressure within the toy gun 10 than the level to which the fluid 32 would rise in the transparent tube 34 without the body 36 disposed therein. While the toy gun 10 illustrated herein includes one pressure gauge 12, it is contemplated that multiple pressure gauges 12 may be provided in a toy gun 10, with each pressure gauge 12 providing a visual indication of the air pressure in the toy gun 10.

Once the toy gun 10 is pressurized, the air may be discharged and a toy projectile launched by the user pulling a trigger 38 that may extend out of the housing 18. The trigger 38 may be a component of a firing mechanism within the housing 18 that causes the compressed air to be discharged and to act upon the toy projectile in a manner that causes the toy projectile to be propelled away from the toy gun 10. When the compressed air is discharged, the air pressure within the toy gun 10 is reduced. The pressure gauge 12 may be in fluid communication with the release mechanism such that the release of air and reduction of the air pressure may be indicated by a reduced level of the fluid 32 in the pressure gauge 12, with the level of the fluid 32 decreasing in proportion to the reduction in air pressure in the toy gun 10.

Figure 2:
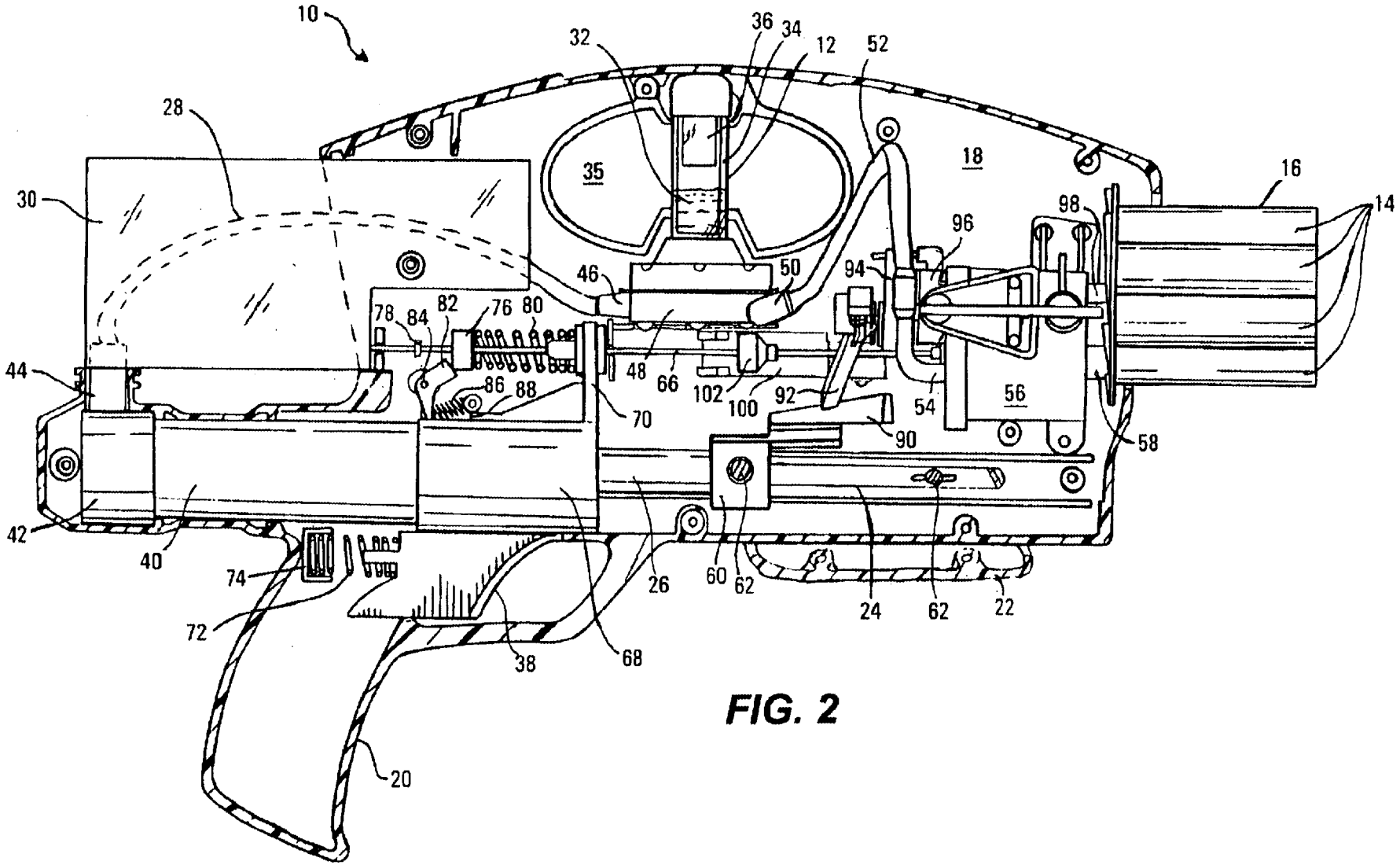
FIG. 2 is a side view of the inside of the pneumatic toy gun of FIG. 1.

Referring now to FIG. 2, one embodiment of pressure gauge 12 and internal mechanism of the toy gun 10 is illustrated. The toy gun 10 may include a pressurizing mechanism for preparing the toy gun 10 to be fired, and a firing mechanism for discharging the compressed air to launch the projectile or projectiles fired by the toy gun 10. One embodiment of a pressurizing mechanism may include a piston assembly having the piston stem 26 and a piston head (not shown) disposed within a cylinder 40 so that movement of the piston stem 26 and piston head toward a closed end 42 of the cylinder 40 compresses air within the toy gun 10. The pressurizing mechanism may further include the hose 28 extending between an outlet 44 of the cylinder 40 and an inlet 46 in a bottom flange 48 of the pressure gauge 12, thereby placing the pressure gauge 12 in fluid communication with the cylinder 40. As will be described more fully below, an air-tight seal exists between the bottom flange 48 and the remaining portions of the pressure gauge 12 that prevents the pressurized air from escaping into either the liquid-filled portion of the pressure gauge 12 or into the surrounding environment.

The bottom flange 48 may have a hollow interior or channel placing the inlet 46 in fluid communication with and outlet 50 such that pressurized air may pass through the bottom flange 48 and into a second hose 52. The second hose 52 may be attached between the outlet 50 of the bottom flange 48 and an inlet 52 of a valve 54, thereby placing the bottom flange 48 in fluid communication with the valve 54. The valve 54, which may be a poppet-type valve, may have a discharge outlet 56, with the valve 54 being normally closed to prevent the release of the pressurized air from the toy gun 10 through the discharge outlet 56 prior to firing. Configured in this manner, the cylinder 40, hoses 28, 52, bottom flange 48, and the valve 56 form an air-tight compartment that retains compressed air until the valve 54 is opened by the firing mechanism.

To allow the user to pressurize the toy gun 10, the handle 22 may be attached to the piston rod 26 at a collar 60. The handle 22 may include posts 62, one of which may engage the collar 60 of the piston rod 26, disposed within the slot 24. The slot 24 may constrain the handle 22 and piston rod 26 to move linearly parallel to the longitudinal axis of the cylinder 40 in order to compress air in the pressurizing mechanism. The outlet 44 may include a one-way valve to allow the user to pump the handle 22 multiple times for greater pressurization by preventing air in the hose 28 from passing back into the cylinder 40 when the handle 22 and piston are drawn forward. As the user pumps the handle 22 one or more times to pressurize the air in the toy gun 10, the level of the fluid 32 in the pressure gauge 12 rises in proportion to the amount of pressure such that the fluid 32 is visible through the transparent tube 34 and the opening 35 in the housing 18. While the pressurizing mechanism is illustrated and described herein as having a piston and cylinder having linear movement to compress air, those skilled in the art will understand that other compression mechanisms, such as bellows, compressed air cartridges, and the like, and methods of achieving pressurization, such as providing a pivoting handle that pressurizes air as the user pivots the handle through its range of motion, are contemplated as having use in toy guns incorporating pressure gauges in accordance with the present invention.

Once pressurized, a firing mechanism of the toy gun 10 controls the discharge of the pressurized air to launch the toy projectile, projectiles, water, etc. The firing mechanism may include the valve 56 which may include an internal stop having a normal position that seals the discharge outlet 58 to maintain the pressure in the toy gun 10, and a discharge position wherein the stop is disengaged from the discharge outlet 58 to allow the pressurized air to pass out of the valve 56 through the discharge outlet 58. The position of the internal stop of the valve 56 may be controlled by a valve stem 66 operatively coupled to the stop within the valve 56 and extending outwardly from the valve 56. When the valve stem 66 is displaced to the left as shown FIG. 2, the internal stop is unseated from the discharge outlet 58 for allow the discharge of the pressurized air.

In order to simulation the firing of a pistol, the valve stem 66 may be operatively coupled to the trigger 38 such that as the trigger 38 is grasped and pulled rearward by the user, the tension on the trigger 38 increases until the firing mechanism is released and the valve stem 66 is displaced to allow the discharge of the pressurized air. The trigger 38 may include a collar 68 disposed and slidable on the outer surface of the cylinder 40 to move the trigger 38 parallel to the longitudinal axis of the valve stem 66. The trigger 38 may further include an arm 70 extending upwardly and partially encompassing the valve stem 66 so that the arm 70 moves along the valve stem 66 without directly engaging and moving the valve stem 66. The trigger 38 may be maintained in the normal forward position under the urging of a spring 72 disposed between the rearward portion of the trigger 38 and a rear bearing surface 74 of the housing 18. While the trigger 38 and accompanying mechanism are illustrated and described in FIG. 2 as moving linearly, it will be apparent to those skilled in the art that the trigger mechanism may be adapted or configured to rotate or move through any other range of motion that causes the firing mechanism to fire the toy gun 10.

The firing mechanism may further include a ram 76 that is slidable on the valve stem 66 between the arm 70 of the trigger 38 and a stop 78 that is formed in or rigidly connected to the valve stem 66 rearward of the arm 70 of the trigger 38. Still further, a spring 80 may be disposed about the valve stem 66 between the arm 70 and the ram 76 and connected to the arm 70 and the ram 76 such that movement of the arm 70 results in either corresponding movement of the ram 76 or an increased force of the spring 80 on the ram 76. To further simulate the firing of a pistol, a pawl 82 may be disposed between the ram 76 and stop 78 when the trigger 38 is disposed in the normal forward position. The pawl 82 may be pivotable about a shaft 84 to allow the pawl 82 to move between a first position wherein the pawl 82 engages the ram 76 to prevent rearward movement of the ram 76 toward the stop 78, and a second position wherein the pawl 82 is disengaged from the ram 76 to allow the ram 76 to move toward the stop 78 under the urging of the spring 80.

To actuate the firing mechanism, the user grasps the hand grip 20 and draws the trigger 38 rearward. As the trigger 38 moves rearward, the collar 68 slides on the cylinder 40 and arm 70 moves rearward toward the ram 76 and stop 78. The pawl 82, which is disposed in the first position under the urging of a spring 86, engages the ram 76 to prevent the ram 76 from moving rearward as the rearward movement of the arm 70 compresses the spring 78. The spring 78 continues to compress and increase the force on the ram 76 as the trigger 38 and arm 70 move rearward until an engagement surface 88 of the trigger 38 engages the pawl 82. The engagement surface 88 causes the pawl 82 to rotate toward the second position as the trigger 38 continues to move rearward. Eventually, the pawl 82 rotates out of engagement with the ram 76. Once the pawl 82 disengages the ram 76, the ram 76 is thrust toward the stop 78 by the force of the spring 78 so that the ram 76 impacts the stop 78 with sufficient momentum to cause the valve stem 66 to move rearward. As the valve stem 66 moves rearward, the internal stop within the valve 56 is unseated from the discharge outlet 58, thereby releasing the pressurized air. The pressurized air is expelled through the discharge outlet 58 and through an orifice in the magazine 16 corresponding to one of the barrels 14 that is aligned with the discharge outlet 58 in a manner that projects a toy projectile disposed in the aligned barrel 14. As the pressurized air is discharged through the discharge outlet 58, the reduction in air pressure within the toy gun 10 is reflected visually in the pressure gauge 12 as the level of the fluid 32 is reduced in proportion to the reduction in air pressure.

When the trigger 38 is released after firing the toy gun 10, the firing mechanism is reset as the trigger 38 is biased forward to its normal position by the spring 72. As the arm 70 moves forward along with the trigger 38, the ram 76 is drawn forward by the spring 78 past the pawl 82. When the ram 76 is disposed forward of the pawl 82, the pawl 82 rotates back to its initial position under the urging of the spring 86.

As previously discussed, the toy gun 10 may further include a magazine 16 having a plurality of barrels 14 that move into and out of alignment with the discharge outlet 58 to launch a plurality of toy projectiles. In order to move the barrels 14 into and out of alignment, the toy gun 10 may further include an indexing mechanism, which may be of the type shown in FIG. 2. The indexing mechanism may be driven by the movement of the handle 22 when the toy gun 10 is pressurized. The indexing mechanism may include a cam surface 90 connected to or formed with the collar 60 that engages a pivoting arm 92 when the handle 22 is drawn rearward. The engagement of the pivoting arm 92 by the cam surface 90 may cause rotation of the pivoting arm 92 about an axis parallel to the direction of motion of the handle 22 such that the pivoting arm 92 may cause a corresponding rotation of a drive arm 94 operatively coupled thereto. The drive arm 94 may in turn drive a ratchet mechanism 96 that facilitates rotation of shaft 98 of the magazine 16 in one direction and prevents rotation of the shaft 98 in the opposite direction.

Movement of the cam surface 90 past the pivoting arm 92 causes the pivoting arm 92 to rotate through an angle that causes the magazine 16 to rotate through an arc that brings the next barrel 14 into alignment with the discharge outlet 58. When the desired angle is achieved by the pivoting arm 92, the pivoting arm 92 may be engaged by a locking arm 100 to prevent the pivoting arm 92 from returning to a position in which the pivoting arm may be driven by the cam surface 90. At this point, the indexing mechanism is set for discharge of the pressurized air by the firing mechanism. When the trigger 38 is pulled and the valve stem 66 is driven rearward by the impact of the ram 76, a second ram 102 disposed on and moving with the valve stem 66 may impact the locking arm 100 to release the pivoting arm 92, freeing the locking arm 92 to rotate back into position to be driven by cam surface 90 when the toy gun 10 is re-pressurized. The indexing mechanism shown in FIG. 2 is illustrative only, and those skilled in the art will understand that other indexing mechanism configurations for moving each of a plurality of toy projectiles into alignment with that discharge outlet 56 for firing may be implemented in pneumatic compressed air launchers having pressure gauges 12 in accordance with the present invention. For example, the indexing mechanism may be driven by the movement of the trigger during actuation of the firing mechanism. Also, a linear magazine or a belt may be substituted for the circular magazine 16 shown herein.

Figure 3A:
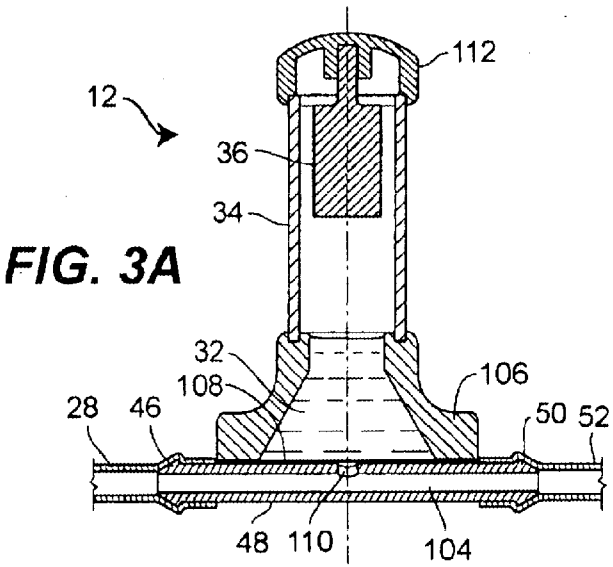
FIGS. 3A–3*d* is a cross-sectional view of the pressure gauge of FIG. 1 with the pneumatic toy gun not pressurized.
Figure 3B:
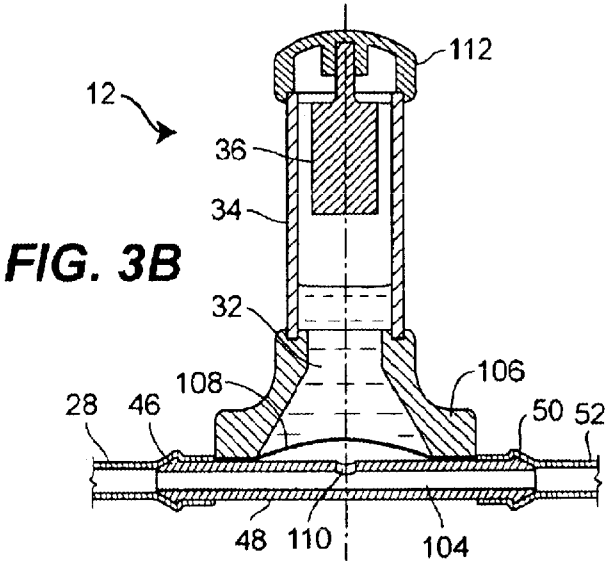
Figure 3C:
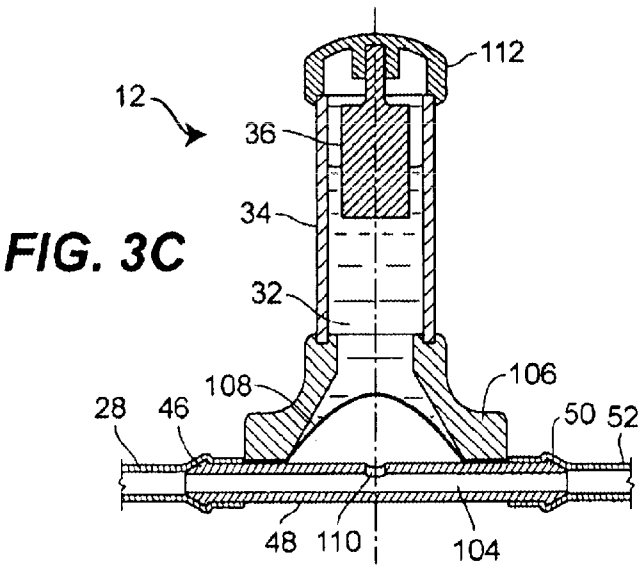
Figure 3D:
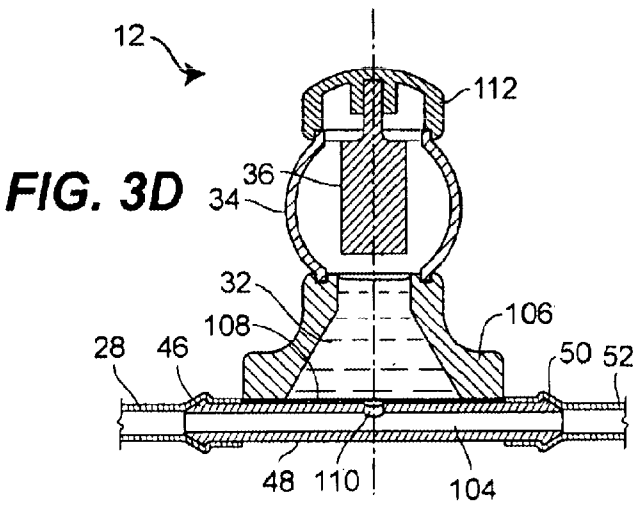

FIGS. 3A–3C illustrate a first embodiment of a pressure gauge 12 in accordance with the present invention. Referring to FIG. 3A, which shows the normal state of the pressure gauge 12 when the toy gun 10 is not pressurized, the pressure gauge 12 may be filled with fluid 32 and have a transparent tube 34 through which the fluid 32 may be visible when sufficient air pressure is built up in the toy gun 10. While the transparent tube 34 as shown has a generally cylindrical shape, it will be understood that the tube 34 may be spherically (FIG. 3D), cubic, conical or have any other geometry. As previously discussed, the pressure gauge 12 may have a bottom flange 28 having an inlet 46 having hose 28 connected thereto in fluid communication with an outlet 50 having hose 52 connected thereto via a channel 104. The bottom flange 48 is connected to a hollow upper housing 106 with a flexible bladder 108 disposed therebetween. The bottom flange 48 and upper housing 106 are joined together by fasteners, adhesive, threads, or other connection methods such that air-tight seals are formed between the bottom flange 48 and the bladder 108, and between the bladder 108 and the upper housing 106. The bottom flange 48 may further include an orifice 110 disposed between the channel 104 and the bladder 108 and placing the bladder 108 in fluid communication with the channel 104 so that the force of the pressurized air within the toy gun 10 and, consequently, the channel 104 bears upon the bladder 108.

The upper housing 106 and bladder 108 form a reservoir for holding some or all of the fluid 32, depending on the amount of air pressure in the toy gun 10. The hollow transparent tube 34 may be disposed at the top of the upper housing 106 and connected to the upper housing 106 in a manner that provides an air-tight seal to prevent the fluid 32 from leaking out of the pressure gauge 12 at the interface of the upper housing 106 and transparent tube 34. A cap 112 may be disposed at the end of the transparent tube 34 opposite the upper housing 106 and also connected to the transparent tube 34 in a manner that provides an air-tight seat. Alternatively, the upper housing 106, transparent tube 34, and cap 112 may be integrally formed as a single component consisting of two or all three of the separate components. Assembled in this manner, the upper housing 106, bladder 108, transparent tube 34 and cap 112 form a sealed cavity isolating the fluid 32 contained therein from the ambient environment. The pressure gauge 12 may further comprise the body 36 within the transparent tube 34 occupying a portion of the volume of the tube 34. As shown in FIG. 3A, the body 36 may be in the form of a stalactite suspended from the inside of the cap 112. However, the body 36 may alternatively be connected to the tube 34, upper housing 106 or the bladder 108, or be detached and free to move within the interior of the pressure gauge 12.

The operation of the pressure gauge 12 is illustrated in FIGS. 3A–3C. In FIG. 3A, the toy gun 10 is in a relatively unpressurized state whereby the force applied by the air in the hoses 28, 52 and the channel 104 through the orifice 110 is insufficient to cause the bladder 108 to deflect into the upper housing 106. In this state, the fluid 32 may be entirely contained within the upper housing 106 such that the fluid 32 is not visible through the transparent tube 34, thereby indicating to the user that the toy gun 10 is not pressurized. Referring to FIG. 3B, the toy gun 10 has been partially pressurized so that the force of the compressed air exerted on the bladder 108 through the orifice 110 is sufficient to cause the bladder 108 to deflect upwardly into the interior of the upper housing 106. As the bladder 108 deflects into the upper housing 106, the volume within the upper housing 106 is reduced, thereby forcing the fluid 32 upward into the transparent tube 34 where the fluid 32 is visible to the user of the toy gun 10. As the air pressure within the toy gun 10 increases with additional pumping of the handle 22, the deflection of the bladder 108 due to the force of the compressed air increases and the level of the fluid 32 continues to rise as shown in FIG. 3C. Once the level of the fluid 32 reaches the body 36 and the volume of the transparent tube 34 is reduced, the fluid level increases at a faster rate in relation to the deflection of the bladder 108, thereby providing a more dramatic visual indication of the increase in air pressure within the toy gun 10. When the toy gun 10 is fired and the compressed air is discharged from the valve 56, the force exerted on the bladder 108 is reduced and the resiliency of the bladder 108 causes the bladder 108 to return toward its normal position. As the bladder 108 returns to the normal position, the volume within the upper housing 106 is recaptured, thereby allowing the level of the fluid 32 to lower until the fluid 32 is again contained within the upper housing 106 and no longer visible to the user as shown in FIG. 3A.

Figure 4A:
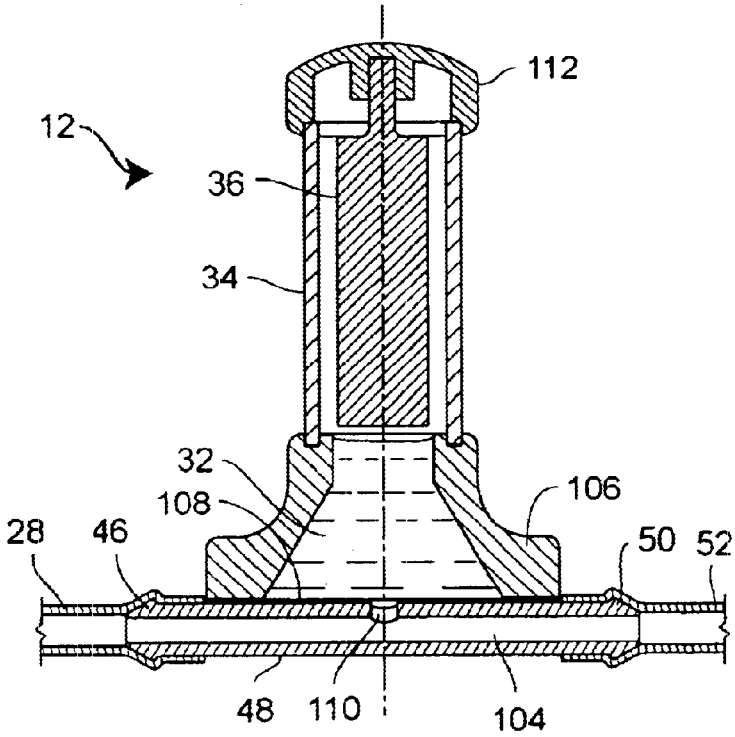
FIGS. 4A and 4B is a cross-sectional view of the pressure gauge of FIG. 1 with the pneumatic toy gun pressurized.
Figure 4B:
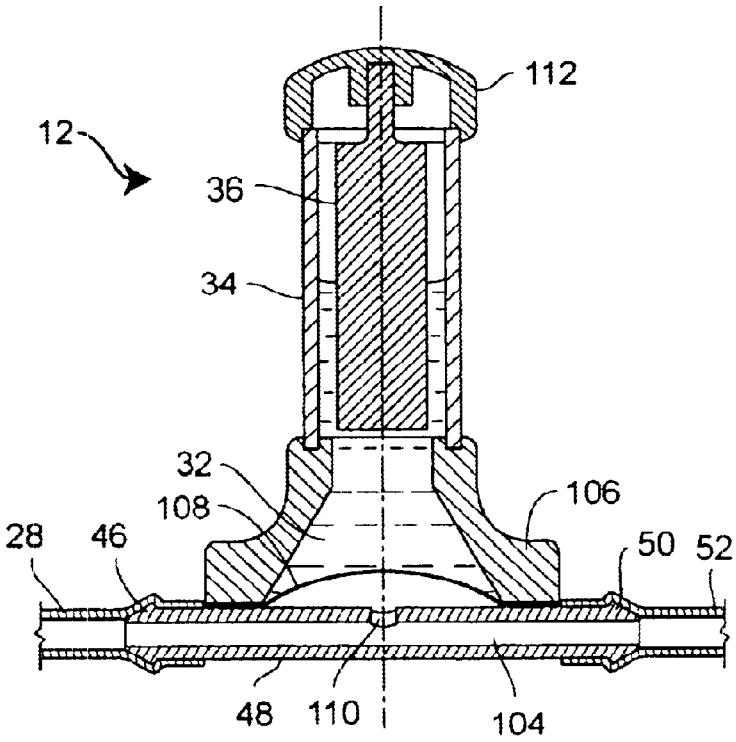
Figure 5A:
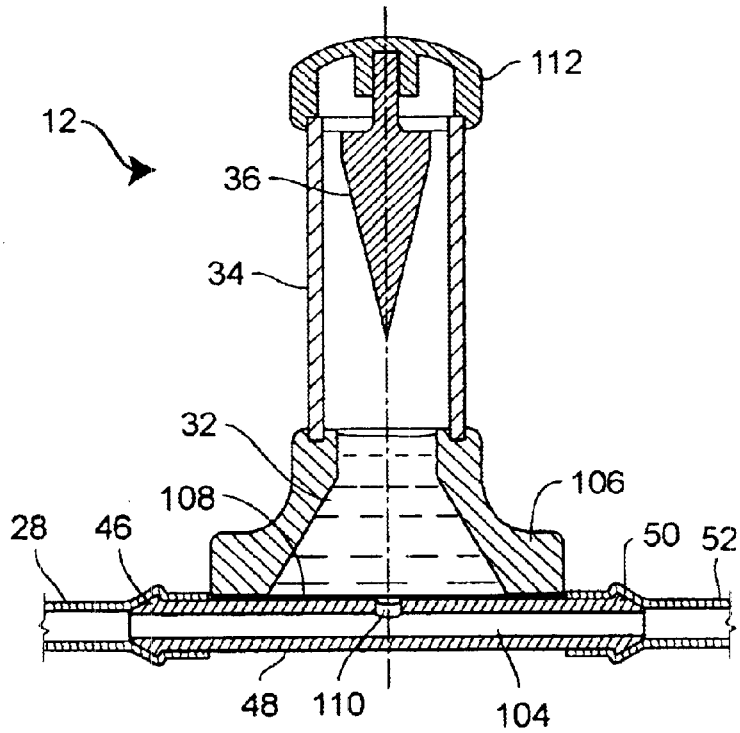
FIGS. 5A and 5B is a cross-sectional of an alternative embodiment of a pressure gauge in accordance with the invention.
Figure 5B:
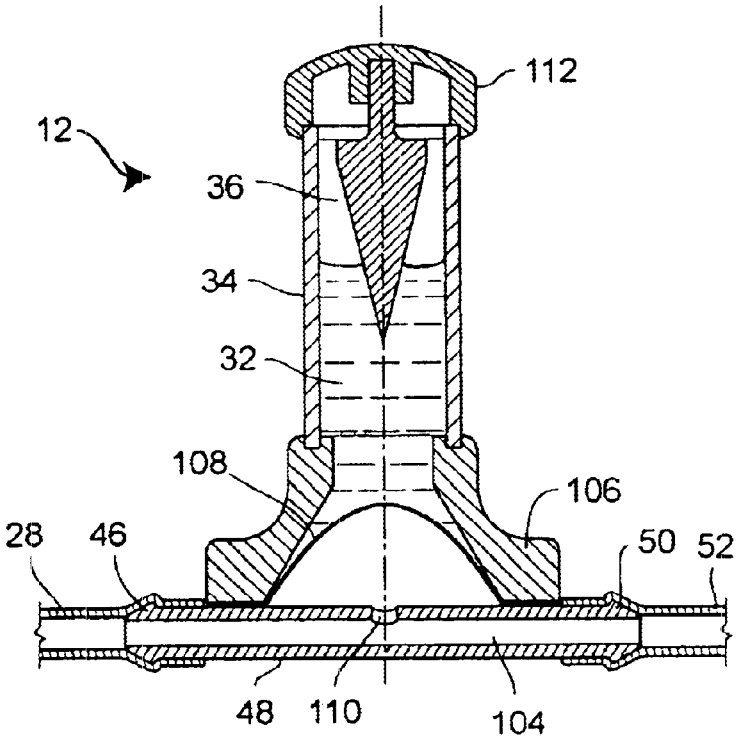
Figure 6A:
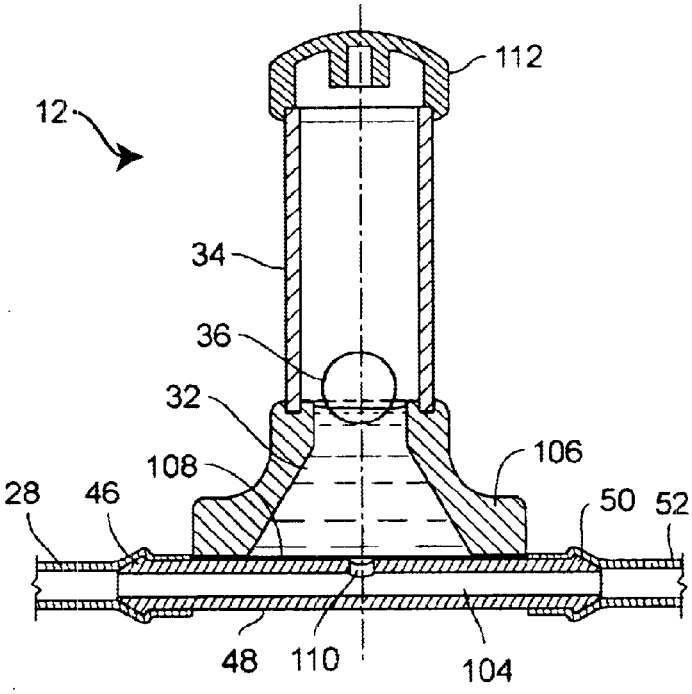
FIGS. 6A and 6B is a cross-sectional of an further alternative embodiment of a pressure gauge in accordance with the invention.
Figure 6B:
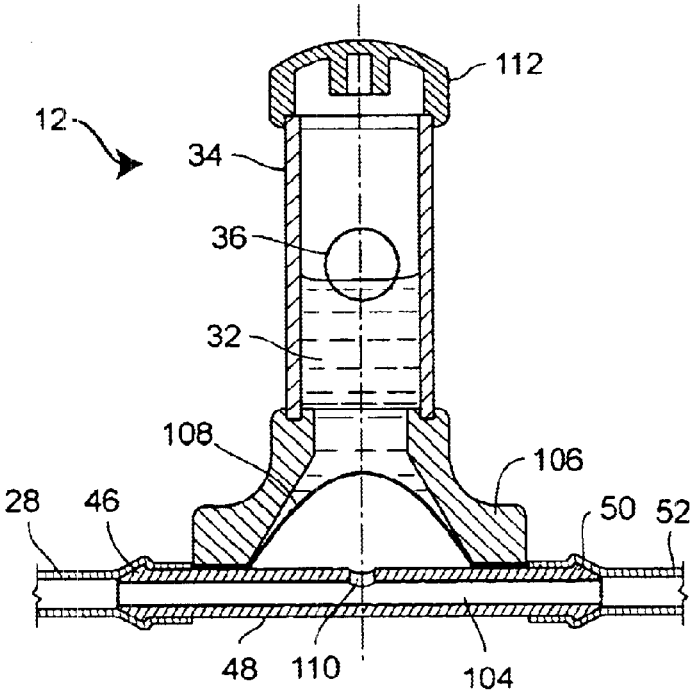

Referring now to FIGS. 4A and 4B, an alternative embodiment of a pressure gauge 12 according to the present invention may include a body 36 extending the entire length of the transparent tube 34 such that the volume within the tube 34 is further reduced and the level of the fluid 32 may increase at a greater rate throughout the pressurization of the toy gun 10 from the unpressurized state of FIG. 4A to the pressurized state of FIG. 4B. In another alternative embodiment shown in FIGS. 5A and 5B, the body 36 may be in the form of a cone or plum, such that the rate of increase in the level of the fluid 32 increases at an increasing rate as the air pressure in the toy gun 10 increases from the upressurized state of FIG. 5A to the pressurized state of FIG. 5B. In a still further alternative embodiment illustrated in FIGS. 6A and 6B, the body 36 is in the form of a detached sphere that floats on the surface of the fluid 32. As the toy gun 10 is pressurized and de-pressurized, the height of the sphere changes as the level of the fluid 32 increases and decreases to indicate the pressure within the toy gun 10.

Figure 7A:
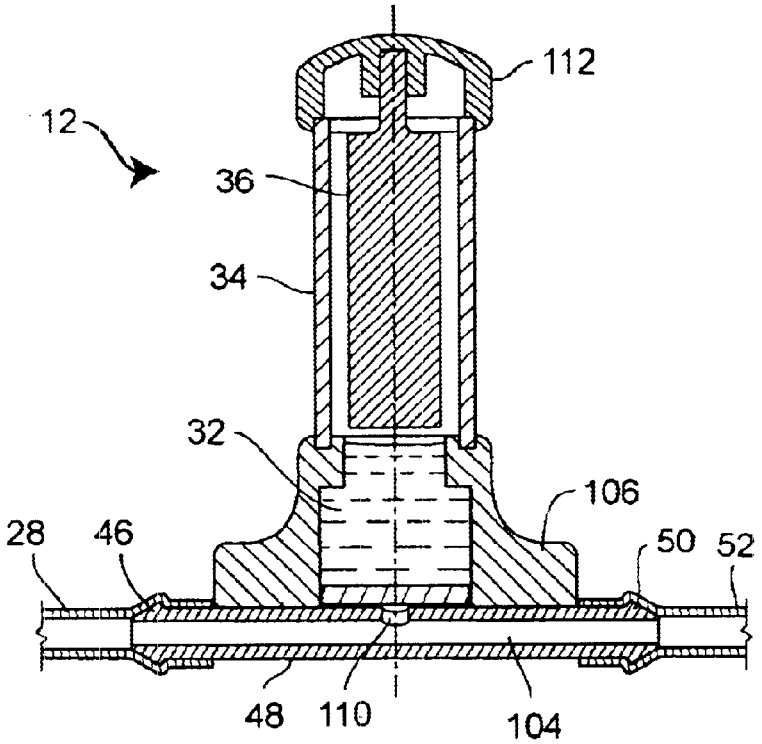
FIGS. 7A and 7B is a cross-sectional of an further alternative embodiment of a pressure gauge in accordance with the invention.
Figure 7B:
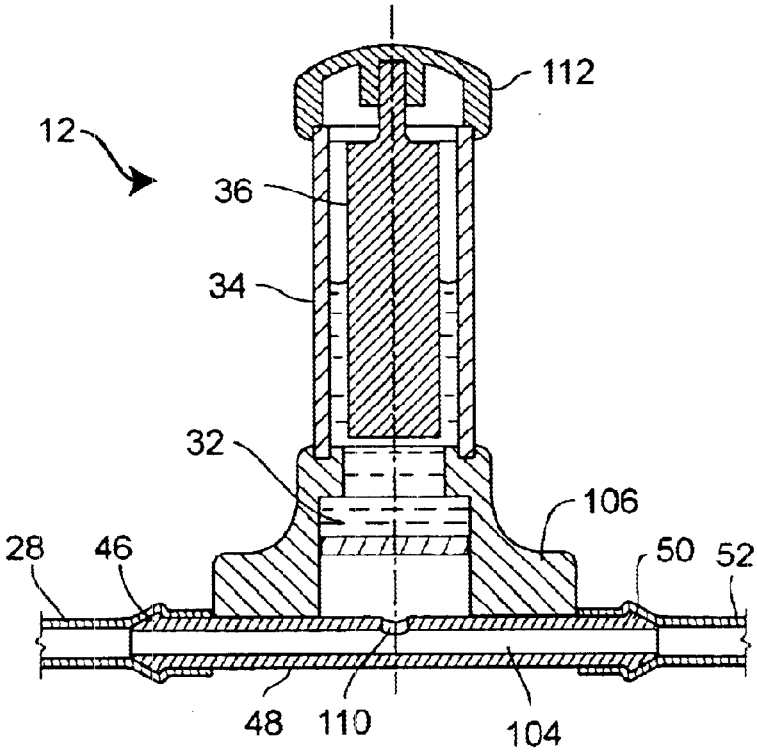

While the pressure gauge 12 is illustrated having the bladder 108 that moves into the upper housing 106 by deflecting under the force of the compressed air, it is contemplated that other types of movable components may be implemented in pressure gauges 12 in accordance with the invention that will reduce the volume inside the pressure gauge 12 and cause the fluid 32 to be visible in the transparent tube 34. For example, the bladder 108 may be replaced with a piston (FIGS. 7A and 7B) that is slidable within the upper portion 106. The piston may include an O-ring or other type of seal so that the piston may engage the upper housing 106 to slide in the upper housing 106 while maintaining an air-tight seal to isolate the interior cavity of the pressure gauge 12. The piston may be in fluid communication with the pressurizing mechanism so that the force of the pressurized air tends to push the piston into the pressure gauge 12, thereby reducing the volume of the interior of the pressure gauge 12 in a similar manner as the deflecting bladder 108. When the air pressure is reduced, the piston may return to its initial position under the urging of gravity, the compressed air and fluid in the pressure gauge 12, a return spring, or other type of biasing mechanism.

Thus, while the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

What is claimed is:

1. A pressure gauge for a pneumatic toy gun, the pressure gauge comprising:

a bottom flange having an inlet, an outlet and an orifice, wherein the inlet, the outlet and the orifice are in fluid communication with each other;

a resilient bladder;

an upper housing having a hollow interior and being connected to the bottom flange with the bladder being disposed between the upper housing and the bottom flange, the orifice of the bottom flange being disposed proximate a surface of the bladder and the bladder being affixed to the bottom flange to form an air-tight seal between the surface of the bladder and the bottom flange such that compressed air in the bottom flange imparts force on the surface of the bladder to deflect the bladder into the interior of the upper housing, the bladder being affixed to the upper housing to form an air-tight seal between the opposite surface of the bladder and the upper housing;

a transparent tube connected to an end of the upper housing opposite the bottom flange and bladder with the tube being in fluid communication with the hollow interior of the upper housing and being affixed to the upper housing to form an air-tight seal between the transparent tube and upper housing;

a cap connected to an end of the transparent tube opposite the upper housing with the cap being affixed to the transparent tube to form an air-tight seal between the transparent tube and upper housing; and a fluid being retentively disposed within a cavity defined by the bladder, the upper housing, the transparent tube and the cap, the volume of the fluid in the cavity being less than the volume of the cavity formed by the bladder, the upper housing, the transparent tube and the cap.

2. A pressure gauge as defined in claim 1, wherein the pneumatic toy gun includes a pressurizing mechanism to compress air within the pneumatic toy gun, wherein compressed air within the pneumatic toy gun is communicated to the bottom flange through the inlet and the outlet, and to the bladder through the orifice, the bladder being adapted to deflect into the hollow interior of the upper housing by an amount proportional to a force applied to the bladder by the compressed air, wherein a portion of the fluid disposed in the transparent tube is proportional to the deflection of the bladder.

3. A pressure gauge as defined in claim 1, wherein the transparent tube is integrally formed with the upper housing.

4. A pressure gauge as defined in claim 1, wherein the transparent tube is integrally formed with the cap.

5. A pressure gauge as defined in claim 1, further comprising a body disposed within the cavity defined by the bladder, the upper housing, the transparent tube and the cap.

6. A pressure gauge as defined in claim 5, wherein the body is a sphere.

7. A pressure gauge as defined in claim 5, wherein the body is connected to the cap.

8. A pressure gauge as defined in claim 1, wherein the transparent tube is a cylinder.

9. A pressure gauge as defined in claim 1, wherein the transparent tube is spherical.

10. A pressure gauge as defined in claim 1, wherein the pneumatic toy gun is a pneumatic water gun.

11. A pressure gauge as defined in claim 1, wherein the pneumatic toy gun is a pneumatic toy projectile launcher.

12. A pneumatic toy gun, comprising:

a cylinder having an open end and an outlet;

a piston disposed within the open end of the cylinder;

a valve having a valve inlet and a discharge outlet, the valve having a normal position wherein the discharge outlet is sealed to prevent the flow of air through the discharge outlet, and an open position wherein the discharge outlet is unsealed to permit the flow of air through the discharge outlet, and wherein the outlet of the cylinder is in fluid communication with the valve inlet; and a pressure gauge in fluid communication with the outlet of the cylinder and the valve inlet, the pressure gauge having a cavity with a fluid disposed therein, the cavity having a transparent portion through which the fluid is visible, wherein movement of the piston within the cylinder compresses air in the cylinder and the valve to increase the air pressure therein, and wherein the amount of the fluid visible through the transparent portion of the pressure gauge is proportional to the air pressure in the cylinder and the valve.

13. A pneumatic toy gun as defined in claim 12, further comprising a firing mechanism being adapted to move the valve from the normal position to the open position whereby the air compressed by the movement of the piston within the cylinder is discharged from the discharge outlet.

14. A pneumatic toy gun as defined in claim 12, wherein the pressure gauge further comprises a body disposed within the cavity.

15. A pneumatic toy gun as defined in claim 14, wherein the body is connected to an interior surface of the cavity.

16. A pneumatic toy gun as defined in claim 12, the cavity of the pressure gauge having a movable portion in fluid communication with the outlet of the cylinder and the valve inlet, the movable portion being adapted to move into the cavity by an amount proportional to a force applied to the movable portion by the compressed air, wherein the amount of the fluid visible in the transparent portion is proportional to the movement of the movable portion.

17. A pneumatic toy gun as defined in claim 12, wherein the movable portion is a resilient bladder.

18. A pneumatic toy gun as defined in claim 12, wherein the movable portion is a sliding piston.

19. A pneumatic toy gun as defined in claim 12, further comprising a housing containing the piston, the cylinder, the valve and the pressure gauge, and including an opening through which the transparent portion of the pressure gauge is visible.

20. A pressure gauge for a pneumatic toy gun having a pressurizing mechanism for compressing air within the pneumatic toy gun, the pressure gauge comprising:

an enclosed housing forming a cavity wherein the interior of the cavity is isolated from the ambient environment, the enclosed housing comprising:

a transparent portion, and a movable portion in fluid communication with the pressurizing mechanism of the pneumatic toy gun, the movable portion being adapted to move into the cavity of the enclosed housing by an amount proportional to a force applied to the movable portion by the compressed air within the pneumatic toy gun; and, a fluid disposed within the cavity of the enclosed housing, wherein the amount of the fluid visible in the transparent portion is proportional to the movement of the movable portion under the force of the compressed air.

21. A pressure gauge as defined in claim 20, further comprising a body disposed within the cavity of the enclosed housing.

22. A pressure gauge as defined in claim 21, wherein the body is a sphere.

23. A pressure gauge as defined in claim 21, wherein the body is connected to an interior surface of the enclosed housing.

24. A pressure gauge as defined in claim 20, wherein the transparent portion is a cylinder.

25. A pressure gauge as defined in claim 20, wherein the transparent portion is spherical.

26. A pressure gauge as defined in claim 20, wherein the pneumatic toy gun is a pneumatic water gun.

27. A pressure gauge as defined in claim 20, wherein the pneumatic toy gun is a pneumatic toy projectile launcher.

* * * * *